US010625972B2

(12) United States Patent
Little

(10) Patent No.: US 10,625,972 B2
(45) Date of Patent: Apr. 21, 2020

(54) THREAD DISPENSER

(71) Applicant: Latika Little, Miami Gardens, FL (US)

(72) Inventor: Latika Little, Miami Gardens, FL (US)

( * ) Notice: Subject to any disclaimer, the term of this patent is extended or adjusted under 35 U.S.C. 154(b) by 0 days.

(21) Appl. No.: 16/044,085

(22) Filed: Jul. 24, 2018

(65) Prior Publication Data

US 2020/0031606 A1 Jan. 30, 2020

(51) Int. Cl.

| | |
|---|---|
| ***B65H 49/20*** | (2006.01) |
| ***B65H 49/30*** | (2006.01) |
| ***B65H 57/06*** | (2006.01) |
| ***B65H 49/26*** | (2006.01) |
| ***B65H 57/04*** | (2006.01) |
| ***B65H 49/32*** | (2006.01) |
| ***A41G 5/00*** | (2006.01) |

(52) U.S. Cl.

CPC ..... *B65H 49/205* (2013.01); *A41G 5/0053* (2013.01); *B65H 49/26* (2013.01); *B65H 49/30* (2013.01); *B65H 49/32* (2013.01); *B65H 57/04* (2013.01); *B65H 57/06* (2013.01); *B65H 2701/31* (2013.01)

(58) Field of Classification Search

CPC ..... B65H 49/205; B65H 49/26; B65H 49/32; B65H 57/04; B65H 57/06; B65H 57/08; B65H 2701/31; A41G 5/0053

See application file for complete search history.

(56) References Cited

U.S. PATENT DOCUMENTS

| | | | | |
|---|---|---|---|---|
| 3,197,096 A * | 7/1965 | Marcocchio | ..... | B65H 49/28 223/107 |
| 5,040,708 A * | 8/1991 | Blair | ..... | A41H 19/00 206/391 |
| 2013/0206807 A1* | 8/2013 | Lee | ..... | B65H 57/06 225/23 |

* cited by examiner

*Primary Examiner* — William E Dondero

(74) *Attorney, Agent, or Firm* — Christopher J. Vandham, P.A.; Chris Vandam

(57) ABSTRACT

A thread dispenser for use when installing hair extensions comprised of a base supporting a spool on a vertical spindle. The top of the base has a guide with a catch to hold and guide the thread towards a cutter on top of the base. The cutter includes a cartridge with a replaceable blade. The blade is recessed and exposed through a mouth for safety. The base includes a plurality of needle holding apertures. Optionally included is a drawer in the base and a tension nut holding the spool onto the spindle.

4 Claims, 2 Drawing Sheets

THREAD DISPENSER

BACKGROUND OF THE INVENTION

1. Field of the Invention

The present invention relates to hair extension beauty treatments, and more particularly, to an improved dispenser for thread and related articles for installing hair extensions.

2. Description of the Related Art

Several designs for thread spools have been designed in the past. None of them, however, includes a thread dispenser adapted to hair extension and related activities that includes am integrated thread guide with catch, needle holders and a cutter allowing the user to retrieve segments of thread with one hand.

Other prior art encompass and describes the competing subject matter that provides for a number of more or less complicated features that fail to solve the problem in an efficient and economical way. None of these patents suggest the novel features of the present invention.

There are a variety of spindles that hold spools of thread without the beneficial features of the present design. Other pin cushions and scissors are available but are not configured for easy one handed use during the tricky process of installing hair extensions and other similar beauty treatments.

A brief abstract of the technical disclosure in the specification and title are provided as well for the purposes of complying with 37 CFR 1.72 and are not intended to be used for interpreting or limiting the scope of the claims.

Without limiting the scope of the invention, a brief summary of some of the claimed embodiments of the invention is set forth below. Additional details of the summarized embodiments of the invention and/or additional embodiments of the invention may be found in the detailed description of the invention below.

SUMMARY OF THE INVENTION

It is one of the main objects of the present invention to provide a thread dispenser adapted for convenient use when installing hair extensions.

It is another object of this invention to provide a thread dispenser that can be used with one hand of the technician while the other hand is free to do other aspects of the hair extension application process, like holding the hair in place when getting a new segment of thread so it doesn't move out of place.

It is still another object of the present invention to provide a beautician's tool that can hold and keep ready supplies and tools for completing a hair extension.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
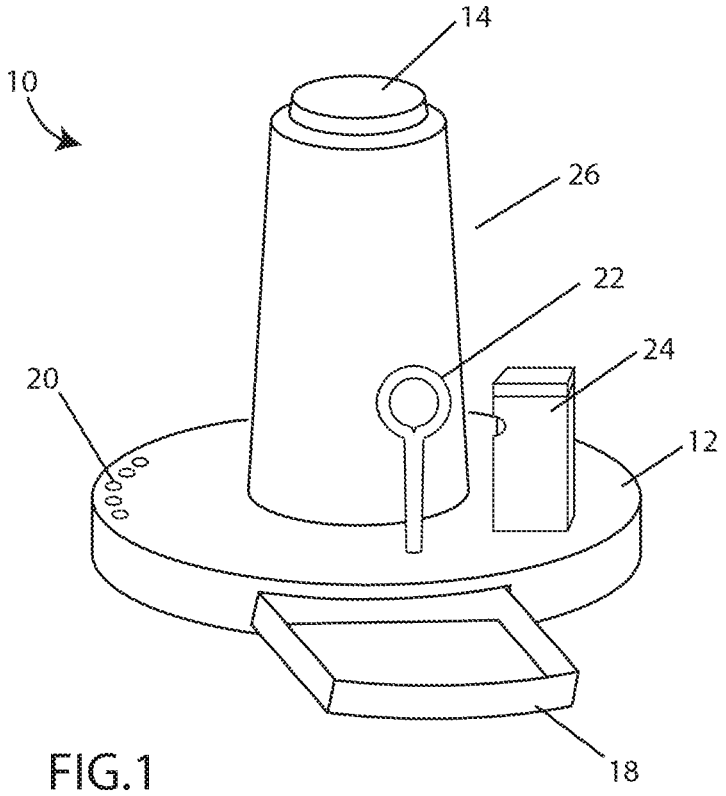
FIG. 1 shows a perspective view of a thread dispenser holding a spool of thread.

While this invention may be embodied in many different forms, there are described in detail herein specific embodiments of the invention. This description is an exemplary of the principles of the invention and is not intended to limit the invention to the particular embodiments illustrated and described.

For the purpose of this disclosure, like reference numerals in the figures shall refer to like features unless otherwise indicated or is obvious by context.

The subject device and method of use is sometimes referred to as the device, the invention, the thread dispenser, the dispenser, the thread holder, the machine or other similar terms. These terms may be used interchangeably as context requires and from use the intent becomes apparent. The masculine can sometimes refer to the feminine and neuter and vice versa. The plural may include the singular and singular the plural as appropriate from a fair and reasonable interpretation in the contextual situation.

The present invention is a device that will hold as well as cut hair extension thread. The device will hold and store hair extension needles. The present invention seeks to provide a solution to the problem of requiring both hands and multiple tools to prepare thread for hair extensions by providing hair care professionals a device that would hold and cut the hair extension thread for them. This will alleviate the hair care professionals from placing the hair extension thread in a drawer to unravel the thread from the spool or from asking the client to hold the spool, both inelegant solutions employed in many salons.

The hair extension thread dispenser has many unique features. It can not only hold the hair extension thread but it can also cut the thread. It can also hold hair extension needles as well has store the unused needles in a compartment drawer.

The drawings show an example of the physical structure. There is a screw on top that connects to the shaft. The shaft in turn connects to the base. Small holes in the base to hold hair extension needles and may be pre-loaded with a segment of thread. In the base is optionally but preferably is a compartment or drawer to store unused hair extension needles or other supplies. Non-skid material may be on the bottom side of the base, such as rubber or foam feet or a pad. There may be weight at the bottom of or inside the base. A standing razor compartment connected to the base is used to cut the hair extension thread. The top opening of the standing razor compartment where the razor is inserted and removed. There is a small opening to expose razor for cutting hair extension thread without risking injury to the user.

The hair extension thread holder is a device that holds and cuts the hair extension thread. It can also hold and store hair extension needles. In one version of the invention the shaft of the product is approximately four or five inches in height can accommodate the different types and sizes of hair extension thread currently in the market. This dimension is not critical but should be adjusted based on the size of thread spools to be used with the device. The shaft may also have a screw on top to prevent the hair extension thread from coming off the shaft.

The base may be circular as seen in the drawings, but other shapes could be equally effective. In one version, the base approximately four or five inches in diameter and about one or two inches in height. These dimensions are merely examples that would prevent the device from falling over during normal use. The bottom of the base would optionally have a non-skid material and/or some type of weight at the bottom of the base preventing it from moving around. There may be several needle sized holes on the top of the base that would hold the hair extension needles. It optionally also has a compartment or drawer in the front of the base where unused hair extension needles can be stored. There is a standing thread cutter device and thread guide attached to the top of the base.

Referring now to the drawings, where the present invention is generally referred to with numeral 10, it can be observed that it basically includes a base 12, a cap 14, a spindle 16, a drawer 18, apertures 20, a guide 22, a cutter 24, a spool 26, a needle 28, a blade 30, a mouth 32, a cap 34, a body 36, a cartridge 38, a stem 40, an eye 42 and a catch 44, among other features shown and described.

Figure 2:
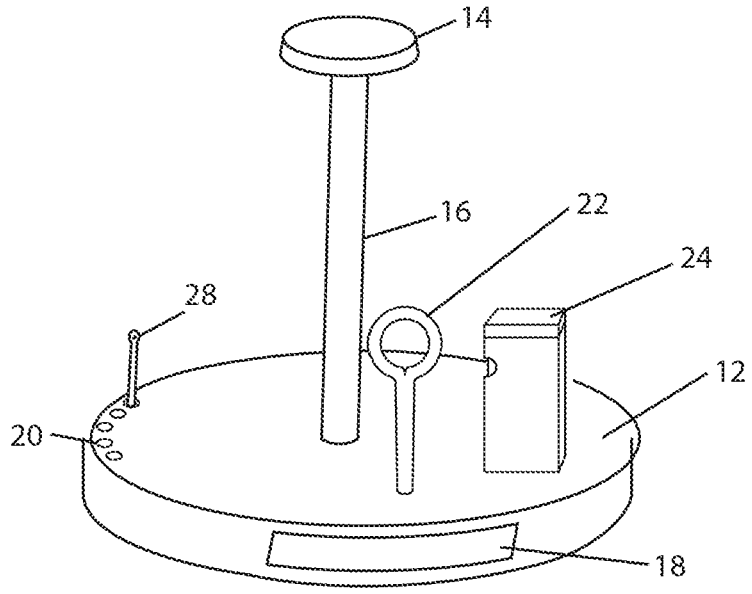
FIG. 2 shows a perspective view of a thread dispenser without a spool of thread.
Figure 3:
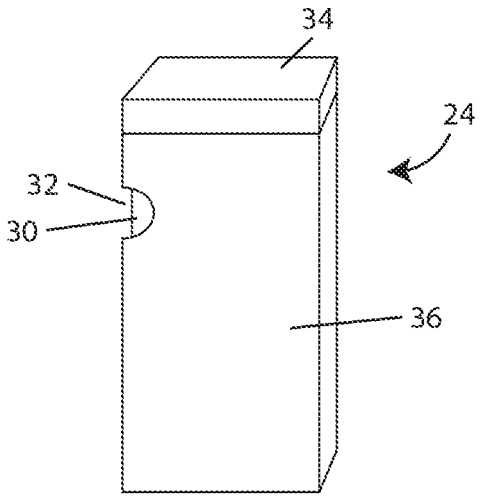
FIG. 3 shows a perspective view of a cutter with a blade installed therein.
Figure 4:
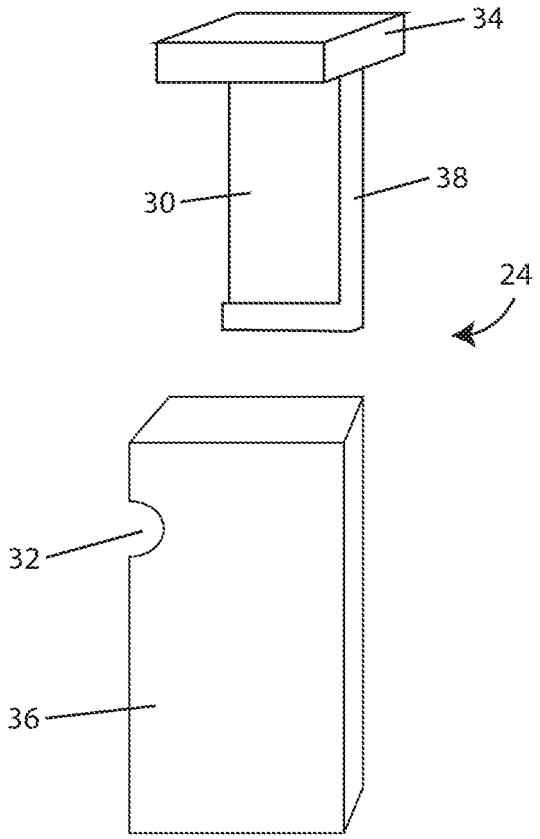
FIG. 4 shows an exploded perspective view of the cutter of FIG. 3 demonstrating a cartridge.

FIGS. 1 and 2 depict the same version of a thread dispenser. A spool 26 of thread or other similar material used for the installation of hair extensions is placed onto the spindle 16. The spool 26 is allowed to rotate on the spindle 16 when the thread is being dispensed.

The top of the spindle 16 may include a cap 14 that secures the spool 26 onto the spindle 16. The cap 14 may be threaded and could be tightened to adjust rotational friction on the spool 26 to reduce the likelihood of free-spooling the spool 26 and inadvertently removing more thread than intended from the spool 26.

When setting up the device for use the tip of the thread on the spool 26 is fed through the guide 22. The guide 22 holds the thread in a position where it can be easily grabbed by the user when being dispensed. The guide 22 is attached to and suspended off of the base 12 by the stem 40 supporting the guide 22.

Figure 5:
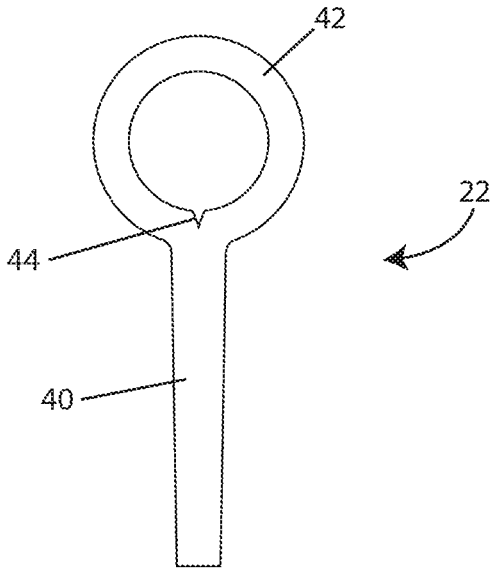
FIG. 5 shows a perspective view of an example of a thread guide with a catch.

Looking at the guide 22 detail in FIG. 5, the thread can be held in the catch 44 so that it does not slip out of the eye 42. When the thread on the spool 26 is pulled, it travels through the eye 42 freely. The use can then dispense as much thread as needed. When a sufficient amount of thread has been taken off the spool 26 the thread can be pulled against the cutter 24 to sever the thread.

After severing the thread the tag end of the thread can be wedged in the catch 44 so that it stays in place in the guide 22 and is easy to locate and grab by the user so the next segment of thread can be dispensed easily without searching for the thread tip.

The base 12 may include a drawer 18 to hold supplies such as a needle threader or spare needles. The drawer 18 may include a handle or a lip that the user can grasp to open it. The drawer 18 may be made of similar materials as the base 12 and may also be flush fit to the base 12 for improved aesthetics.

The base 12 may include one or more apertures 20 that are dimensioned and adapted to hold a needle 28. The needles 28 may be threaded with a segment of thread and placed in the aperture 20 to be ready for the hair extension process. This may allow the installing technician to use only one hand to retrieve a needle 28 that is ready to go with thread.

A cutter 24 is affixed to the base 12 so that thread being dispensed off the spool 26 passing through the guide 22 is presented to the blade 30 in the cutter 24 and can be easily cut. The cutter 24 allows the installer to cut the thread without use of a scissors which would require two hands: one to hold the thread and the other to snip the scissors.

The blade 30 is shielded inside the cutter 24 to prevent injury to the user of the device. The blade 30 is exposed through a mouth 32. The blade 30 is recessed in the body 36 of the cutter 24.

The blade 30 may be held in a cartridge 38 that fits inside the body 36 of the cutter 24. In this version, the blade 30 snaps in and out of the cartridge 38 for replacement when it becomes dull from use after cutting thread. The blade 30 may be flipped end over end or front to back to expose a new section of cutting edge to extend the service life of the blade 30. To this end, the mouth 32 is not centered on the body 36.

The cartridge 38 may include a cap 34 that supports the cartridge 38. The cap 34 snaps into the top of the body 36 and prevents the cartridge 38 and blade 30 from accidentally separating from the protective body 36, further enhancing safety.

The bottom of the base 12 may include a non-slip feature. For example, rubber feet or a rubber pad may be affixed onto the bottom surface of the base 12 to help hold the thread dispenser in place during use. This can also help ensure that the device may be used with only one had of the operator.

An important version of the invention can be fairly described as a thread dispenser comprised of, among other features, a base, a guide and a cutter. An upper surface of the base has a vertical spindle adapted to hold a preselected spool of thread for installing hair extensions. The spool of thread rotates on the spindle when the thread is dispensed. The guide is affixed to the upper surface of the base outside the footprint of the spool. The guide has an eye on an upper end through which the thread passes. The eye has a catch that holds a dispensed thread so it doesn't fall out of the eye after thread is dispensed. The cutter contains a blade affixed to a removable cartridge. The blade is exposed though a mouth on the cutter to protect the user from inadvertent cuts. The cutter is affixed to the upper surface of the base and oriented relative to the guide so that the dispensed thread is exposed to the blade. The cutter is outside of the footprint of the spool. The upper surface of the base includes a plurality of apertures dimensioned to hold a preselected needle so the needles are at the ready. Optionally, the thread dispenser base may have an integral drawer. Optionally, the thread dispenser is held onto the spindle with a tension nut to adjust the frictional resistance of the spool relative to the base so the spool does not free spool and the spool will not accidentally fall off the spindle during transport.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A thread dispenser comprised of a base, a guide and a cutter;

an upper surface of the base has a vertical spindle adapted to hold a preselected spool of thread;

the spool of thread rotates on the spindle;

the guide is affixed to the upper surface of the base;

the guide has an eye on an upper end;

the eye has a catch on an inside surface of the eye that holds a dispensed thread without removing the thread from inside the eye;

the cutter contains a blade affixed to a removable cartridge;

the blade is exposed though a mouth on the cutter;

the cutter is affixed to the upper surface of the base and oriented relative to the guide so that the dispensed thread is exposed to the blade;

the upper surface of the base includes a plurality of apertures below a bottom side of the spool of thread dimensioned to hold a preselected needle.

2. The thread dispenser in claim 1 further characterized in that the base has an integral drawer.

3. The thread dispenser in claim 2 further characterized in that the spool of thread is held onto the spindle with a threaded cap.

4. The thread dispenser in claim 1 further characterized in that the spool of thread is held onto the spindle with a threaded cap to selectively apply rotational friction to prevent the spool of thread from free-spooling.

* * * * *